United States Patent [19]

Sweeney et al.

[11] 4,191,011

[45] Mar. 4, 1980

[54] MOUNT ASSEMBLY FOR POROUS TRANSITION PANEL AT ANNULAR COMBUSTOR OUTLET

[75] Inventors: Ralph B. Sweeney; Albert J. Verdouw, both of Indianapolis, Ind.

[73] Assignee: General Motors Corporation, Detroit, Mich.

[21] Appl. No.: 862,859

[22] Filed: Dec. 21, 1977

[51] Int. Cl.[2] ..... F02C 7/12; F02C 7/20

[52] U.S. Cl. ..... 60/39.32; 60/754; 431/352

[58] Field of Search ..... 60/39.31, 39.32, 39.36, 60/39.37, 39.66; 415/134, 138; 431/352

[56] References Cited

U.S. PATENT DOCUMENTS

| | | | |
|---|---|---|---|
| 2,702,454 | 2/1955 | Brown | 60/39.32 |
| 2,709,338 | 5/1955 | Morley et al. | 60/39.32 |
| 2,846,847 | 8/1958 | Simmons | 60/39.37 |
| 2,915,280 | 12/1959 | Sonder | 415/138 |
| 3,349,558 | 10/1967 | Smith | 431/352 |
| 3,670,497 | 6/1972 | Sheldon | 60/39.32 |
| 3,965,066 | 6/1976 | Sterman et al. | 60/39.32 |
| 4,016,718 | 4/1977 | Lauck | 60/39.32 |

*Primary Examiner*—Carlton R. Croyle

*Assistant Examiner*—Thomas I. Ross

*Attorney, Agent, or Firm*—J. C. Evans

[57] ABSTRACT

A gas turbine engine combustor assembly of annular configuration has outer and inner walls made up of a plurality of axially extending multi-layered porous metal panels joined together at butt joints therebetween and each outer and inner wall including a transition panel of porous metal defining a combustor assembly outlet supported by a combustor mount assembly including a stiffener ring having a side undercut thereon fit over a transition panel end face; and wherein an annular weld joins the ring to the end face to transmit exhaust heat from the end face to the stiffener ring for dissipation from the combustor; a combustor pilot member is located in axially spaced, surrounding relationship to the end face and connector means support the stiffener ring in free floating relationship with the pilot member to compensate for both radial and axial thermal expansion of the transition panel; and said connector means includes a radial gap for maintaining a controlled flow of coolant from outside of the transition panel into cooling relationship with the stiffener ring and said weld to further cool the end face against excessive heat build-up therein during flow of hot gas exhaust through said outlet.

4 Claims, 3 Drawing Figures

MOUNT ASSEMBLY FOR POROUS TRANSITION PANEL AT ANNULAR COMBUSTOR OUTLET

The invention described herein was made in the performance of work under a NASA contract and is subject to the provisions of Section 305 of the National Aeronautics and Space Act of 1958, Public Law 85-568 (72 Stat. 435; 42 U.S.C. 2457).

This invention relates to gas turbine engine combustor assemblies and, more particularly, to gas turbine engine combustors having porous liner panels forming the walls thereon and to mount assemblies for an outlet transition panel of the combustor assemblies.

Various proposals have been suggested for improving combustion in gas turbine engines by uniformly flowing combustion air into a combustion chamber through porous liner portions of a combustor apparatus. Such an arrangement produces transpiration cooling of combustor liner and more particularly transpiration cooling of an annular outlet formed by radially spaced outlet transition panels from the combustor to direct hot gas exhaust to a downstream turbine which is driven by flow of exhaust gases therethrough.

In such proposals the porous metal transition panels must be carried by suitable mount configurations to maintain structural integrity of the combustion apparatus by permitting free radial and axial thermal growth of the outlet end of the combustor without undesirably affecting the smooth flow of combustion air from exteriorly of the combustor apparatus liner into the interior combustion chamber thereof. Furthermore, it is necessary to have a mount configuration that avoids excessive pressure drop through the axial extent of the combustor apparatus from the inlet to the outlet thereof. A further objective of such an arrangement is to interconnect the outlet transition panels of the liner wall to a combustor pilot member so as to direct combustion air flow through all segments of the outlet transition panel to prevent thermal erosion of the outlet end thereof and more particularly at the end face of the combustor apparatus outlet transition panel.

In U.S. Pat. No. 2,504,106, issued Apr. 18, 1950, to Berger, a combustor is shown with wire screen liner panels of different porosity from the inlet dome of the combustor to a porous transition outlet segment. The panels are joined by imperforate connector strips of annular form that are lapped over adjacent end segments of the liner panels. In such arrangements, the connector strips have substantial axial extent that will reduce the inward flow of combustion air from a diffusion chamber around the combustion liner into the combustion zone. Accordingly, the combustor liner connection points can be subject to undesirable thermal erosion including erosion at the transition panel end. Moreover, the transition panel is rigidly connected to a downstream tailpipe.

U.S. Pat. No. 3,186,168 issued June 1, 1965, to Ormerod et al., shows a solid wall combustor with an outlet transition section that is supported for free axial thermal growth. U.S. Pat. No. 4,016,718, issued Apr. 12, 1977, to Lauck, shows another solid wall combustor with its transition section supported for free radial thermal growth. While the aforesaid configurations are suitable for their intended purpose, they do not meet the needs of freely supporting low strength porous combustor transition panels by easily assembled components that do not produce hot spots in the porous material of the outlet transition panel.

An object of the present invention, therefore, is to provide an improved gas turbine engine combustor assembly mount for porous metal transition outlet panels including ends joined at a butt connection to a stiffener and heat dissipation ring by a continuous annular weldment joining exposed ends of multi-layered porous metal material to the ring so as to avoid air flow restriction from the diffuser chamber of a combustor into the outlet from the transition panels and wherein the ring is connected to means for supporting the outlet end of the transition section for free axial and radial thermal expansion thereof and including means defining a radial air coolant gap across the ring to cool the combustor outlet and to control air flow through the porous panels.

Still another object of the present invention is to provide an improved combustor support including a plenum forming casing in surrounding relationship to an outer annular wall made up of a plurality of axial extending, separate, multi-layered porous metal panels including an outlet transition panel having an outer surface and a plurality of layers of porous material defining an outlet opening for exhaust flow from the combustor, the transition panel having an end face therearound joined to a stiffener ring having a side undercut fit over the end face to reinforce it and wherein an annular weld joins the ring to the end face to transmit exhaust heat from the end face to the stiffener ring for dissipation from the combustor and wherein a combustor pilot member is located in axially spaced surrounding relationship to the end face and connector means are provided for supporting the stiffener ring on said pilot member in free floating relationship therewith to compensate for both radial and axial thermal expansion of the transition member; said connector means including means for maintaining a controlled axial air gap between the stiffener ring and the pilot member for flow of coolant from outside of said transition panel into cooling relationship radially across said stiffener ring and said weld to cool the end face against excessive heat build-up therein during flow of exhaust gas through said outlet.

Further objects and advantages of the present invention will be apparent from the following description, reference being had to the accompanying drawings wherein a preferred embodiment of the present invention is clearly shown.

Figure 1:
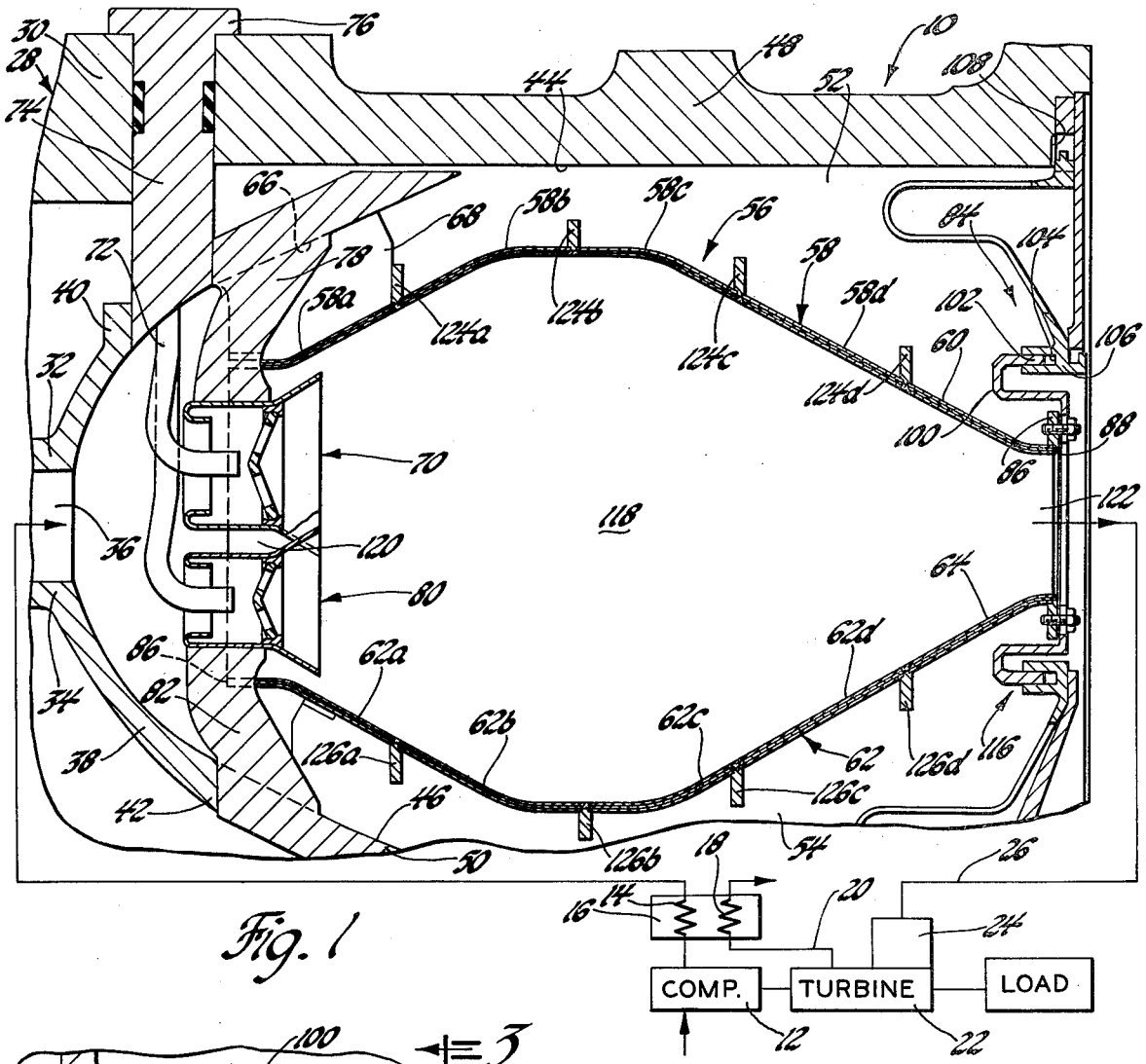
FIG. 1 is a longitudinal cross-sectional view showing a half section of a combustor apparatus constructed in accordance with the present invention.

Referring now to the drawings, a gas turbine engine combustor assembly 10 is illustrated in FIG. 1 associated with a diagrammatically shown gas turbine engine system including a compressor 12 for directing inlet air through the inlet pass 14 of a regenerator 16 that has an outlet pass 18 therefrom for receiving heated exhaust air from the outlet passage 20 leading from a power turbine 22 that is in communication with an inlet nozzle 24 leading from an outlet conduit 26 from the combustor assembly 10. This system is representative of known gas turbine engines suitable for association with the present invention.

The combustor assembly 10 of the present invention more particularly includes an annular end casing 28 including a radially outwardly directed flange 30 thereon. Casing 28 supports spaced walls 32, 34 defining an annular inlet 36 to an inlet air dome 38 with annular outer and inner flanges 40, 42 which merge with interior walls 44, 46 of an annular outer case 48 and an annular inner case 50, respectively, that form an outer annular diffuser plenum 52 and an inner annular diffuser plenum 54 located radially outwardly and radially inwardly of a liner assembly 56 constructed in accordance with the present invention.

More particularly, the liner assembly 56 includes an outer wall 58 made up of a plurality of axially extended, multi-layer porous metal panels **58*a*–58*d* joined together at butt ends thereof and with panel 58*d* being joined to an outer annular outlet transition panel member 60 of like porous material. Likewise, the liner assembly 56 includes an inner wall member 62 made up of a plurality of axially extending panels 62*a*–62*d* joined at opposite butt ends thereof and each being made up of multi-layers of porous metal material. Panel 62*d* is joined to an inner annular outlet transition panel member 64** of like porous material. Examples of such material are set forth in U.S. Pat. No. 3,584,972, issued June 15, 1971, to Bratkovich et al.

More particularly, the outer wall 58 has an annular inlet segment or panel **58*a* with an open end aligned coaxially of an open end 66 of the inlet air dome 38. A plurality of radially inwardly directed struts 68 connect between the outer case 48 and the panel 58*a* to fixedly locate the outer wall 58 radially outwardly of and circumferentially surrounding a plurality of circumferentially spaced air fuel injectors 70 each of which, in the illustrated arrangement, includes a fuel pipe 72 supported by a fuel supply tube 74 having an outer flange 76 thereon supportingly received on the flange 30 and the outer case 48. Struts 78 support fuel injectors 70 from wall 48. Likewise, a second plurality of fuel injectors 80 are supported as a ring about inner wall 62 by a plurality of struts 82 between the inner case 50 and an inlet panel 62*a* of the inner liner 62 at the open inlet end 86 thereof. Each of the fuel injectors 70, 80** are of the air blast type.

The wall panels **58*a*–58*d* and 62*a*–62*d* are flared outwardly from the inlet to diverge radially outwardly toward the outer case 48 and inner case 50 and then converve radially inwardly toward the outlet transition panels 60, 64. Panel 60 is carried by an annular support assembly 84 having a stiffener ring 86 welded to the end 88 of transition panel 60. The ring 86 is joined to an outer support ring 100 by means of a threaded stud 92 having a nut 94 threaded on stud 92 and overlying a slot 96 in a radially inwardly directed flange 98 of an annular U-shaped support ring 100. Ring 100 has an axial extension 102 thereon freely axially supported within an open slot 104 in a transition section carriage 106 supported to and dependent from the aft end 108 of the outer case 48. Stud 92 threads into ring 86 and nut 92 is adjusted on stud 92 to establish an axial gap 110 between the end face 112 of ring 86 and the inboard surface 114 of flange 98**.

Likewise, the inner wall 62 and its transition segment 64 are connected to a radially inwardly located, annular support assembly 116 having parts corresponding to those shown in the outer annular support assembly 84.

By virtue of the aforedescribed arrangement, a reaction zone 118 within walls 58, 60 has an expanded configuration from an inlet annulus 120 up to a mid-point represented by the transition between the wall panels **58*b*–58*c* of the outer wall 58 and the wall panels 62*b*–62*c* of the inner wall 62 and thereafter the combustion chamber reaction zone 118 is of decreasing annular volume to a reduced annular outlet opening 122 which leads to the inlet nozzle 24 of the turbine 22**.

The fact that each of the wall panels is porous causes a controlled flow of air from the diffuser plenums 52, 54 into the combustion chamber. If desired, the porosity of given wall panels can be changed by matching cooling requirements along the combustor wall to provide uniform wall temperature.

Figure 2:
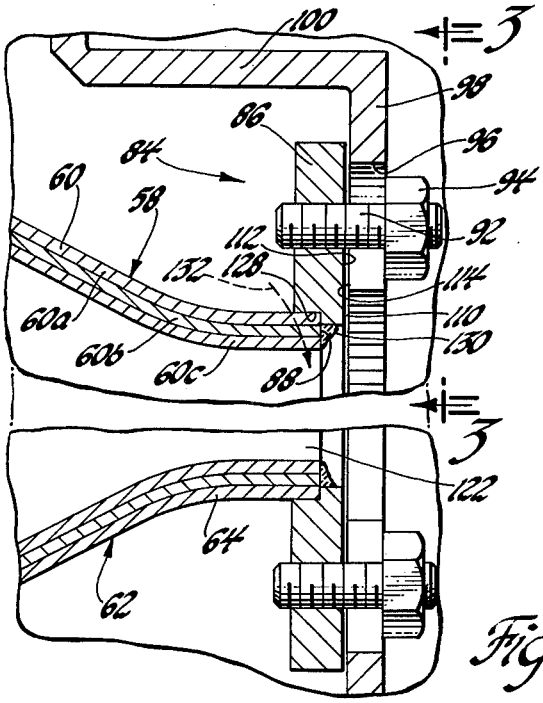
FIG. 2 is an enlarged, fragmentary vertical sectional view of a combustor mount in the combustor apparatus of FIG. 1.

While the porous metal panels and the controlled air flow therethrough have an advantage from a combustion standpoint, in large diameter applications of the type illustrated in FIGS. 1 and 2, such porous metal panels must be reinforced to maintain structural integrity.

Accordingly, the combustor apparatus includes an arrangement for interconnecting the segments to one another at the inner and outer walls 62,58; at outer wall 58, a plurality of axially spaced reinforcing rings **124*a*–124*d* are provided, for connecting the abutting outer wall panels together. Likewise, a second plurality of reinforcing rings 126*a*–126*d* are provided to reinforce the inner wall 62. The reinforcing rings are formed continuously around the outer wall at axial spaced points thereon as are the reinforcing rings on the inner wall 62**. The rings serve a dual function of reinforcement and heat dissipation.

Each of the rings form part of an improved connector joint more particularly set forth in my copending U.S. application, Ser. No. 862,858, filed concurrently herewith.

The ring 86 of the improved annular combustor support assembly 84 likewise serves a dual function including structural reinforcement at the outlet end 88 of the annular transition panel 60 and also as a means for dissipating heat therefrom to reduce thermal erosion at the end 88. The ring 86 has an undercut side edge 128 that is fit over an outer layer **60*a* of the panel 60 and it defines a space for an annular weld 130 that is connected to the end faces of panel layers 60*b*, 60*c*. The resultant structure enables coolant to flow through pores within the layers 60*a* through 60*c* closely adjacent the stiffener ring 86 as shown by the dotted arrow 132 in FIG. 2**.

The aforesaid design produces a combustor air seal at the transition as defined by the gap 110 so that high pressure air will be forced across the path 132 all the way to the transition tips of layer **60*b*, 60*c* at the end face 88. Thus, an improved air cooling flow occurs at the transition end between the outlet at the liner assembly 56 and the conduit 26** leading therefrom.

Moreover, the aforesaid mount and air gap seal design include provision for both radial and axial combustor thermal expansion and also ease of assembly. The radial expansion is provided by the free radial play between the shank of the stud 92 and the slot 96 and axial thermal growth is compensated for by relative movement between the axial extension 102 on the ring 100 and the support slot 104 formed on the transition section carriage 106.

Further advantages of the aforesaid arrangement are that leakage from the plenums 52, 54 is accurately controlled by setting the indicated gap 110 to maintain a predetermined high pressure within the plenums 52, 54 to assure adequate air coolant flow across the panels 58*a*–58*d* and 62*a*–62*d* throughout the length of the combustor liner 56. Moreover, the arrangement enables a small air leakage to continuously flow across the face 112 of the ring 86 so that the seal and stiffening ring components of the assembly are cooled to reduce thermal erosion.

Furthermore, the aforesaid arrangement enables assembly to be facilitated by a non-lock construction. Moreover, in order to assure a dimensional control in the joined parts, the end face 112 of the stiffener ring 86 can be remachined after the stiffening ring 86 has been welded to the panel 60 thereby to assure accurate axial spacing in the assembly.

Figure 3:
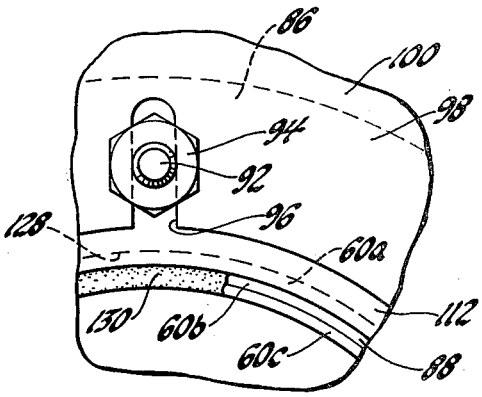
FIG. 3 is a vertical sectional view taken along the line 3—3 in FIG. 2 looking in the direction of the arrows.

Following assembly of the non-lock assembly of the component parts of the structure shown in FIGS. 2 and 3, the stud 92 and nut 94 can be tack-welded in place.

Further objects and advantages of the present invention will be apparent from the following description, reference being had to the accompanying drawings wherein a preferred embodiment of the present invention is clearly shown.

The embodiments of the invention in which an exclusive property or privilege is claimed are defined as follows:

1. A gas turbine engine combustor mount assembly comprising an annular combustor outlet transition panel having an outer surface and at least one layer of porous material defining an outlet for exhaust flow from the combustor, said transition panel having an end face therearound and pores extending therethrough up to said end face for directing coolant through transition panel from the outer surface to said end face, a stiffener ring connected to said end face downstream thereof to permit unrestricted flow of coolant from said outer surface to said end face and furthermore to reinforce said transition panel, an annular weld joining said ring to said end face to transmit exhaust heat from the end face to said stiffener ring for dissipation from the combustor, a combustor pilot member located in axially spaced surrounding relationship to said end face, connector means for supporting said stiffener ring on said pilot member in free floating relationship therewith to compensate for both radial and axial thermal expansion of said transition member, said connector means including means for maintaining a controlled axial air gap between said stiffener ring and said pilot member at a point downstream of said end face for defining an air seal to maintain a high pressure coolant level at said outer surface all the way to said end face for forcing air through said pores in said transition panel for cooling said transition panel all the way to said end face and for flow of coolant outside of said transition member into cooling relationship with said stiffener ring and said weld to cool the end face against excessive heat build-up therein during flow of exhaust through said outlet.

2. A gas turbine engine combustor mount assembly comprising an annular combustor outlet transition panel having an outer surface and at least one layer of porous material defining an outlet for exhaust flow from the combustor, said transition panel having an end face therearound, a stiffener ring connected to said end face to reinforce said transition panel, an annular weld joining said ring to said end face to transmit exhaust heat from the end face to said stiffener ring for dissipation from the combustor, a combustor pilot member located in axially spaced surrounding relationship to said end face, connector means for supporting said stiffener ring on said pilot member in free floating relationship therewith to compensate for both radial and axial thermal expansion of said transition member, said connector means including means for maintaining a controlled axial air gap between said stiffener ring and said pilot member for flow of coolant outside of said transition member into cooling relationship with said stiffener ring and said weld to cool the end face against excessive heat build-up therein during flow of exhaust through said outlet, said last mentioned means including a plurality of radial slots in said pilot member, a stud directed axially through each of said slots into threaded engagement with said stiffener ring and an adjustment nut on said stud overlying one of said slots and axially positionable on said stud against said pilot member to establish the width of said air gap.

3. A gas turbine engine combustor mount assembly comprising an annular combustor outlet transition panel having an outer surface and a plurality of layers of porous material defining an outlet for exhaust flow from the combustor, said transition panel having an end face therearound and pores extending therethrough up to said end face for directing coolant through transition panel from the outer surface to said end face, a stiffener ring having a side undercut thereon fit over said end face downstream thereof to permit unrestricted flow of coolant from said outer surface to said end face and furthermore to reinforce said transition panel, an annular weld joining said ring to said end face to transmit exhaust heat from the end face to said stiffener ring for dissipation from the combustor, a combustor pilot member located in axially spaced surrounding relationship to said end face, connector means for supporting said stiffener ring on said pilot member in free floating relationship therewith to compensate for both radial and axial thermal expansion of said transition member, said connector means including means for maintaining a controlled axial air gap between said stiffener ring and said pilot member at a point downstream of said end face for defining an air seal to maintain a high pressure coolant level at said outer surface all the way to said end face for forcing air through said pores in said transition panel for cooling said transition panel all the way to said end face and for flow of coolant outside of said transition member into cooling relationship with said stiffener ring and said weld to cool the end face against excessive heat build-up therein during flow of exhaust gas through said outlet.

4. A gas turbine engine combustor mount assembly comprising an annular combustor outlet transition panel having an outer surface and a plurality of layers of porous material defining an outlet for exhaust flow from the combustor, said transition panel having an end face therearound, a stiffener ring having a side undercut thereon fit over said end face to reinforce said transition panel, an annular weld joining said ring to said end face to transmit exhaust heat from the end face to said stiffener ring for dissipation from the combustor, a combustor pilot member located in axially spaced surrounding relationship to said end face, connector means for supporting said stiffener ring on said pilot member in free floating relationship therewith to compensate for both radial and axial thermal expansion of said transition member, said connector means including means for maintaining a controlled axial air gap between said stiffener ring and said pilot member for flow of coolant outside of said transition member into cooling relationship with said stiffener ring and said weld to cool the end face against excessive heat build-up therein during flow of exhaust gas through said outlet, said last mentioned means including a plurality of radial slots in said pilot member, a stud directed axially through each of said slots into threaded engagement with said stiffener ring and an adjustment nut on said stud overlying one of said slots and axially positionable on said stud against said pilot member to establish the width of said air gap.

* * * * *